US008561433B2

(12) United States Patent
Kellogg

(10) Patent No.: US 8,561,433 B2
(45) Date of Patent: Oct. 22, 2013

(54) DEVICE AND METHOD FOR REPAIRING A KNITTED ARTICLE

(76) Inventor: Bonnie Lee Kellogg, Hayward, CA (US)

( * ) Notice: Subject to any disclaimer, the term of this patent is extended or adjusted under 35 U.S.C. 154(b) by 0 days.

(21) Appl. No.: 13/290,424

(22) Filed: Nov. 7, 2011

(65) Prior Publication Data

US 2012/0111064 A1 May 10, 2012

Related U.S. Application Data

(60) Provisional application No. 61/412,250, filed on Nov. 10, 2010.

(51) Int. Cl.
*D04B 17/04* (2006.01)

(52) U.S. Cl.
USPC ..... 66/1.5; 66/2

(58) Field of Classification Search
USPC ..... 66/1 R, 1 A, 1.5, 116–118, 2
See application file for complete search history.

(56) References Cited

U.S. PATENT DOCUMENTS

| | | | | | |
|---|---|---|---|---|---|
| 268,442 | A * | 12/1882 | Wahl | 66/118 |
| 1,269,014 | A * | 6/1918 | Stansbery | 66/118 |
| 1,303,327 | A * | 5/1919 | Jensen | 66/118 |
| 1,477,427 | A * | 12/1923 | Christensen | 66/118 |
| 1,502,584 | A * | 7/1924 | Perry | 66/118 |
| 1,524,328 | A * | 1/1925 | Wolverton | 66/117 |
| 2,217,524 | A * | 10/1940 | Neuschwanger | 66/118 |
| 2,271,477 | A * | 1/1942 | Davis | 66/117 |
| D133,543 | S * | 8/1942 | Megarry | D3/28 |
| 2,364,649 | A * | 12/1944 | Palliser | 66/117 |
| 2,539,479 | A * | 1/1951 | Robertson | 66/1 A |
| 3,229,484 | A * | 1/1966 | Standart | 66/118 |
| 4,047,397 | A * | 9/1977 | Laliberte | 66/118 |
| 4,172,372 | A * | 10/1979 | Murakami | 66/195 |
| 4,280,641 | A * | 7/1981 | Eacret | 223/1 |
| D269,734 | S * | 7/1983 | Okada | D3/28 |
| 4,603,560 | A * | 8/1986 | Pietrowski | 66/1 R |
| D386,899 | S * | 12/1997 | Carroll | D3/18 |
| 7,117,693 | B1 * | 10/2006 | Nova | 66/117 |
| 7,669,441 | B2 * | 3/2010 | Zeleny | 66/117 |
| 2012/0111064 | A1 * | 5/2012 | Kellogg | 66/1 A |

* cited by examiner

*Primary Examiner* — Danny Worrell
(74) *Attorney, Agent, or Firm* — GSS Law Group

(57) ABSTRACT

The present application describes a device and method for repairing dropped stitches and for correcting errors in previously knitted rows in a knitted article. The knitting repair tool of the present invention comprises a first hook and a second hook at opposite ends of a relatively short elongated shaft for recovering a first stitch and for recovering a second stitch in a knitted article, wherein the second stitch is recovered after the first stitch has been recovered, without releasing the recovered first stitch from the knitting repair tool. The present invention describes various methods for repairing dropped stitches in a knitted article wherein a first dropped stitch that is recovered is not released prior to recovering a second dropped stitch.

14 Claims, 9 Drawing Sheets

DEVICE AND METHOD FOR REPAIRING A KNITTED ARTICLE

CROSS REFERENCE TO RELATED APPLICATIONS

This application claims the benefit of the priority date of provisional patent application Ser. No. 61/412,250 filed Nov. 10, 2011, which is hereby incorporated by reference in its entirety.

BACKGROUND

A knitted article consists of consecutive rows of loops, called stitches. Stitches in a row of a knitted article are linked vertically to stitches above and below each row. As each row is created, a new loop is pulled through an existing loop to link the rows. The active loops are held on a knitting needle until a new loop is pulled through them and they are linked to the previous row. In knitting, dropping a stitch occurs when a stitch is inadvertently released from one of the knitting needles without being properly attached to the next row. A dropped stitch will progress down through the knitted article resulting in a series of horizontal ladder rungs filling the gap where the stitch was dropped. In order to repair a dropped stitch in a knitted article it is necessary to locate the last remaining intact loop of the dropped stitch and properly attach the intact loop to the subsequent row of the knitted article thereby recovering the dropped stitch on that row. This process must be repeated until the dropped stitch is properly attached to each of the subsequent rows and the stitch that was inadvertently released is placed back onto the knitting needle.

Various methods are known in the art for repairing a dropped stitch, or other knitting mistake, in a knitted article. One prior art method utilizes a single device, such as a crochet hook, knitting needle or finger, to reattach the dropped loop to the subsequent row in the knitted article. However, when using a single device to repair a garter stitch comprising a combination of both knit stitches and purl stitches, after the knit stitch is recovered from the front side of the article, the recovered knit stitch must be released from the crochet hook to recover the next purl stitch from the opposite side of the article. After releasing the recovered knit stitch from the device, recovering the purl stitch can be accomplished by either pulling the purl stitch through the released knit stitch from the back side of the article or by turning the article over and then pulling the purl stitch through the released knit stitch from the front side of the article. With this method the stitch must be released between recovering a knit stitch and a purl stitch, which greatly increases the chance that the stitch will be dropped again. Releasing the knit stitch from the crochet hook, holding onto the loop of the knit stitch and then reinserting the crochet hook into the loop to repair the purl stitch often results in distortion and uneven stitches in the knitted article. Additionally, turning the article over each time to recover the next stitch greatly increases the time necessary to make the repair. Alternatively, two devices, such as two crochet hooks, a crochet hook and a knitting needle, etc. could be used to recover the alternating knit and purl stitches by passing the recovered stitch from one device to the other device. With this method it is not necessary to turn the article over each time to recover the next stitch, but the stitch must be passed between the two devices which are placed on opposite sides of the article. As such, the recovered stitch must be released from one device and transferred to another device to recover the next stitch. Manipulating the two devices simultaneously is difficult to accomplish and transferring the stitch between the two devices often results in another dropped stitch. Additionally, when passing the stitch from one device to the other it is easy to accidentally pick up additional rows of the knitted article and inadvertently create twisted stitches or other undesirable effects. When utilizing two devices to repair the article, the devices must be properly matched to create stitches that are similarly sized. In addition, even if the two devices are substantially similar in size, passing the stitches from one device to the other inadvertently results in distortion of the stitches as the size and shape of the stitch are altered during the transfer. Uneven stitches are an undesirable result of utilizing two different devices to repair a knitted article.

Crochet hooks having a hook on both ends are known in the art. Such double-ended crochet hooks are used for two-sided crocheting commonly referred to as an Afghan stitch. Double-sided crochet hooks known in the art are commonly ten or fourteen inches in length. In creating an Afghan stitch, the length of the double-ended crochet hook used is necessary to retain the stitches on the hook while crocheting back across the article. Double-ended crochet hooks have not been previously used in the art to repair a knitted article. The design of double-ended crochet hooks known in the art, having a length of at least ten inches, are cumbersome to handle in attempting to repair a knitted article. Additionally, the necessary length of the double-ended crochet hooks increases their weight. The additional weight of the hooks makes them awkward for use in the repair of a knitted article. The relatively long length and relatively heavy weight of the double-ended crochet hooks known in the art renders such a device impractical and inefficient for the repair of a knitted article. As such, double-ended crochet hooks known in the art cannot be reasonably used for repairing a knitted article.

There is an unmet need in the art for a device for repairing a dropped stitch in a knitted article that does not require releasing a previously recovered stitch from the device prior to recovering the next stitch.

There is an unmet need in the art for a device for repairing a dropped stitch in a knitted article that does not require rotating the knitted article 180° after recovering a first stitch in order to recover the next stitch.

Thus, there is a need for an improved device and method for efficiently repairing a knitted article. In particular, there is a need in the art for a device and method for repairing a knitted article that does not require the use of two independent repair devices or require that the stitch being repaired be released from a repair device to recover the next stitch to complete the repair. Additionally, there is a need in the art for a device and method for repairing a knitted article that does not require turning the knitted article to accomplish the repair.

There is a need in the art for a method of repair that will allow the knitter to follow a complicated pattern and make repairs from the front side of a knitted fabric keeping the right side of the fabric on the top to follow the pattern and execute the stitches necessary to accomplish the repair.

SUMMARY

The present application describes a device and method for repairing a knitting mistake in a knitted article. In particular, the present application describes a device and method for repairing dropped stitches in a knitted article or for making corrections to stitches in previously knitted rows. A knitting repair tool for repairing stitches in a knitted article is provided which includes a substantially rigid elongated shaft of relatively short length having a substantially circular cross-section. The elongated shaft has a first end and a second end, the first end having a first throat tapering to a first hook at the first end of the shaft and the second end having a second throat tapering to a second hook at the second end of the shaft. The first hook and the second hook are of substantially the same dimension as the circular cross-section of the elongated shaft and the first hook is substantially aligned with the second hook, which are facing inwardly toward the shaft.

In a specific embodiment, the elongated shaft of the knitting repair tool is approximately between four inches and five inches in length. The length of the elongated shaft of the knitting repair tool is considered to be of relatively short length. Other lengths of the elongated shaft are within the scope of the present invention wherein the length of the elongated shaft of the knitting repair tool has the advantage of being dimensioned to perform as a practical and efficient tool for repairing a knitted article.

In a particular embodiment, the throat forming the hook at the each end of the elongated shaft is substantially deeper than required to accommodate the yarn thickness of the knitted article that is being repaired. As such, the throat securely holds the yarn within the hook as the repair is being performed. If the throat of the knitting repair tool were not substantially deeper than necessary to accommodate the yarn of the knitted article being repaired, the yarn would be easily released from the hook during the repair and the effectiveness of the knitting repair tool for its intended purpose would be reduced.

A method of the present invention for repairing a knitted article comprising at least two dropped stitches includes, recovering a first dropped stitch by hooking a bottommost horizontal bar of a first dropped stitch and pulling the bottommost horizontal bar through an intact loop of the knitted article and recovering a second dropped stitch by hooking a next bottommost horizontal bar of a second dropped stitch and pulling the next bottommost horizontal bar through the first recovered stitch. With this method, the second dropped stitch is recovered without releasing the first recovered stitch.

In a specific embodiment, the knitted article may be rotated 180° after recovering the first dropped stitch to recover the second dropped stitch. However, with the method of the present invention it is not necessary to rotate the knitted article 180° after recovering the first dropped stitch to recover the second dropped stitch and in a preferred embodiment, the knitted article is not rotated between recovering the first dropped stitch and recovering the second dropped stitch.

A method for repairing dropped stitches in a garter stitch knitted article includes rotating the knitted article 180° such that the bottommost horizontal bar is a bottommost knit bar. With the knitted article in the proper orientation, the method of the present invention includes inserting a first hook of an elongated shaft into an intact loop from a front side of the knitted article, positioning the first hook below the bottommost knit bar and pulling the bottommost knit bar through the intact loop from a front side of the knitted article, thereby recovering a dropped knit stitch. After the dropped knit stitch has been recovered, the method further includes sliding the elongated shaft perpendicular to the knitted article, through the recovered knit stitch, to position the recovered knit stitch proximate to a second hook of the elongated shaft. To recover the dropped purl stitch, the method includes positioning the second hook below the bottommost purl bar and pulling the bottommost purl bar through the recovered knit stitch from the back side of the knitted article, thereby recovering the dropped purl stitch. As such, the method of the present invention includes recovering a dropped knit stitch and recovering a dropped purl stitch without releasing the recovered knit stitch and without rotating the knitted article. The method may further include sliding the elongated shaft perpendicular to the knitted article, through the recovered purl stitch, to position the recovered purl stitch proximate to the first hook and repeating the method steps until each of the dropped stitches have been recovered and the last recovered loop has been placed back onto the knitting needle.

In an additional embodiment, a method for repairing dropped stitches in a garter stitch knitted article includes rotating the knitted article 180° such that the bottommost horizontal bar is a bottommost knit bar. With the knitted article in the proper orientation, the method of the present invention includes inserting a first hook of an elongated shaft into the intact loop from a front side of the knitted article, hooking the bottommost knit bar from above and pulling the bottommost knit bar through the intact loop from a front side of the knitted article, thereby recovering a dropped knit stitch. After the dropped knit stitch has been recovered, the method further includes pivoting the elongated shaft about the recovered knit stitch and sliding the elongated shaft parallel to the knitted article to position the recovered knit stitch proximate to a second hook of the elongated shaft and then sliding the elongated shaft perpendicular to the knitted article, through the recovered knit stitch, to position the recovered knit stitch proximate to the first hook of the elongated shaft. To recover the dropped purl stitch, the method includes positioning the first hook above the bottommost purl bar and pulling the bottommost purl bar through the recovered knit stitch from the back side of the knitted article, pivoting the elongated shaft about the recovered knit stitch and sliding the elongated shaft parallel to the knitted article to position the recovered purl stitch proximate to the second hook of the elongated shaft, thereby recovering the dropped purl stitch. As such, the method of the present invention includes recovering a dropped knit stitch and recovering a dropped purl stitch without releasing the recovered knit stitch and without rotating the knitted article. The method may further include sliding the elongated shaft perpendicular to the knitted fabric, through the recovered purl stitch, to position the recovered purl stitch proximate to the first hook and repeating the method steps until each of the dropped stitches have been recovered.

In an additional embodiment, a method for repairing dropped stitches in a garter stitch knitted article includes rotating the knitted article 180° such that the bottommost horizontal bar is a bottommost knit bar. With the knitted article in the proper orientation, the method of the present invention includes inserting a first hook of an elongated shaft into the intact loop from a front side of the knitted article, hooking the bottommost knit bar from below and pulling the bottommost knit bar through the intact loop from a front side of the knitted article, thereby recovering a dropped knit stitch. After the dropped knit stitch has been recovered, the method further includes sliding the elongated shaft perpendicular to the knitted article, through the recovered knit stitch, to position the recovered knit stitch proximate to a second hook of the elongated shaft. To recover the dropped purl stitch, the method includes positioning the second hook above the bottommost purl bar and pulling the bottommost purl bar through the recovered knit stitch from a back side of the knitted article, pivoting the elongated shaft about the recovered knit stitch and sliding the elongated shaft parallel to the knitted article to position the recovered purl stitch proximate to the first hook of the elongated shaft, thereby recovering the dropped purl stitch. As such, the method of the present invention includes recovering a dropped knit stitch and recovering a dropped purl stitch without releasing the recovered knit stitch and without rotating the knitted article. The method may further include sliding the elongated shaft perpendicular to the knitted article, through the recovered purl stitch, to position the recovered purl stitch proximate to the second hook and repeating the method steps until each of the dropped stitches have been recovered.

In an additional embodiment, a method for repairing dropped stitches in a garter stitch knitted article includes rotating the knitted article 180° such that the bottommost horizontal bar is a bottommost knit bar. With the knitted article in the proper orientation, the method of the present invention includes inserting a first hook of an elongated shaft into the intact loop from a front side of the knitted article, hooking the bottommost knit bar from above and pulling the bottommost knit bar through the intact loop from a front side of the knitted article, pivoting the elongated shaft about the recovered knit stitch and sliding the elongated shaft parallel to the knitted article, through the recovered knit stitch, to position the recovered knit stitch proximate to a second hook of the elongated shaft, thereby recovering a dropped knit stitch. After the dropped knit stitch has been recovered, the method further includes sliding the elongated shaft perpendicular to the knitted article, through the recovered knit stitch, to position the recovered knit stitch proximate to the first hook of the elongated shaft. To recover the dropped purl stitch, the method includes positioning the first hook below the bottommost purl bar and pulling the bottommost purl bar through the recovered knit stitch from a back side of the knitted article, thereby recovering the dropped purl stitch. As such, the method of the present invention includes recovering a dropped knit stitch and recovering a dropped purl stitch without releasing the recovered knit stitch and without rotating the knitted article. The method may further include sliding the elongated shaft perpendicular to the knitted article, through the recovered purl stitch, to position the recovered purl stitch proximate to the second hook and repeating the method steps until each of the dropped stitches have been recovered.

In an additional embodiment, the knitted article is a seed stitch knitted article and the method for repairing the dropped stitches includes, rotating the knitted article 180° such that the bottommost horizontal bar is a bottommost knit bar and the next bottommost horizontal bar is a bottommost purl bar if the bottommost horizontal bar is a bottommost purl bar. With the knitted article in the proper orientation, the method of the present invention includes inserting a first hook of an elongated shaft into the intact loop from a front side of the knitted article, sliding the elongated shaft perpendicular to the knitted fabric, through the intact loop, to position the intact loop proximate to a second hook of the elongated shaft, positioning the second hook of the elongated shaft above the bottommost knit bar and hooking the bottommost knit bar with the second hook from above and pulling the bottommost knit bar through the intact loop from a back side of the knitted article with the second hook, thereby recovering the dropped knit stitch. After the dropped knit stitch has been recovered, the method further includes pivoting the elongated shaft about the recovered knit stitch and sliding the elongated shaft parallel to the knitted article, through the recovered knit stitch, to position the recovered knit stitch proximate to the first hook of the elongated shaft. The method further includes, sliding the elongated shaft perpendicular to the knitted article, through the recovered knit stitch, to position the recovered knit stitch proximate to the second hook of the elongated shaft, positioning the second hook of the elongated shaft below the bottommost purl bar and hooking the bottommost purl bar with the second hook from below and pulling the bottommost purl bar through the recovered knit stitch from a front side of the knitted article with the second hook, thereby recovering the dropped purl stitch. The method may further include, sliding the elongated shaft perpendicular to the knitted article, through the recovered purl stitch, to position the recovered purl stitch proximate to the first hook of the elongated shaft and repeating the method until each of the dropped stitches in the knitted article are repaired.

In another embodiment, the knitted article is a seed stitch knitted article and the method for repairing the dropped stitches includes, rotating the knitted article 180° such that the bottommost horizontal bar is a bottommost knit bar and the next bottommost horizontal bar is a bottommost purl bar if the bottommost horizontal bar is a bottommost purl bar. With the knitted article in the proper orientation, the method of the present invention includes inserting a first hook of an elongated shaft into the intact loop from a front side of the knitted article, sliding the elongated shaft perpendicular to the knitted fabric, through the intact loop, to position the intact loop proximate to a second hook of the elongated shaft, positioning the second hook of the elongated shaft above the bottommost knit bar and hooking the bottommost knit bar with the second hook from above, pulling the bottommost knit bar through the intact loop from a back side of the knitted article with the second hook, pivoting the elongated shaft about the recovered knit stitch and sliding the elongated shaft parallel to the knitted article, through the recovered knit stitch, to position the recovered knit stitch proximate to the first hook of the elongated shaft, thereby recovering the dropped knit stitch. After the dropped knit stitch has been recovered, the method further includes, sliding the elongated shaft perpendicular to the knitted article, through the recovered knit stitch, to position the recovered knit stitch proximate to the second hook of the elongated shaft, positioning the second hook of the elongated shaft above the bottommost purl bar and hooking the bottommost purl bar with the second hook from above, pulling the bottommost purl bar through the recovered knit stitch from a front side of the knitted article with the second hook, pivoting the elongated shaft about the recovered knit stitch and sliding the elongated shaft parallel to the knitted article, through the recovered purl stitch, to position the recovered purl stitch proximate to the first hook of the elongated shaft, thereby recovering the dropped purl stitch. The method may further include, sliding the elongated shaft perpendicular to the knitted article, through the recovered purl stitch, to position the recovered purl stitch proximate to the second hook of the elongated shaft and repeating the method until each of the dropped stitches in the knitted article are repaired.

In an additional embodiment, the knitted article is a garter stitch knitted article and recovering the knit stitch and recovering the purl stitch are both performed from the front side of the knitted article. The method includes rotating the knitted article 180° such that the bottommost horizontal bar is a bottommost knit bar and the next bottommost horizontal bar is a bottommost purl bar if the bottommost horizontal bar is a bottommost purl bar. With the knitted article in the proper orientation, the method of the present invention includes inserting a first hook of an elongated shaft into the intact loop from a front side of the knitted article, positioning the first hook below the bottommost knit bar and hooking the bottommost knit bar with the first hook from below, pulling the bottommost knit bar through the intact loop from a front side of the knitted article with the first hook, thereby recovering the dropped knit stitch. After the dropped knit stitch has been recovered, the method continues by sliding the elongated shaft parallel to the knitted article and behind the bottommost purl bar to position the recovered knit stitch proximate to a second hook of the elongated shaft, hooking the recovered knit stitch with the second hook of the elongated shaft, pulling the recovered knit stitch behind the bottommost purl bar to position the recovered knit stitch and the second hook of the elongated shaft above the bottommost purl bar, rotating the elongated shaft to position the second hook to face downward and hooking the bottommost purl bar with the second hook from above and pulling the bottommost purl bar through the recovered knit stitch from the front side of the knitted article with the second hook, thereby recovering the dropped purl stitch.

DETAILED DESCRIPTION

Figure 1A:
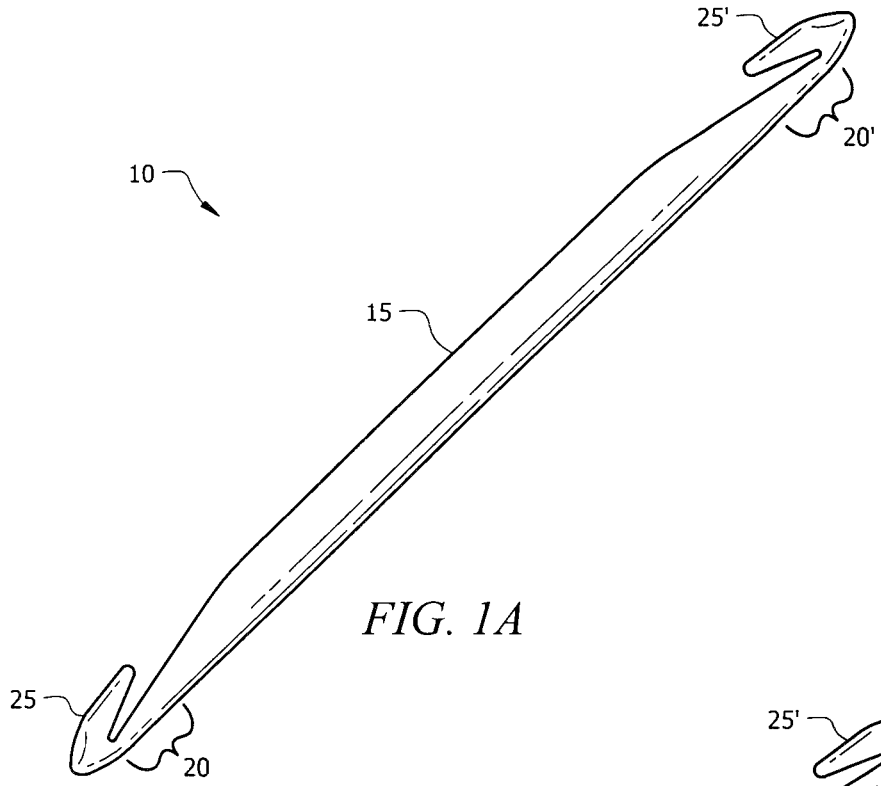
FIG. 1A-1B are diagrams illustrating the knitting repair tool in accordance with the present invention.

Those of ordinary skill in the art will realize that the following detailed description of embodiments in this specification is illustrative only, and is not intended to be in any way limiting. Other embodiments will readily suggest themselves to such skilled persons having the benefit of this disclosure. It will be apparent to one skilled in the art that these specific details may not be required to practice the embodiments. In the following description of the embodiments, substantially the same parts are denoted by the same reference numerals.

Numerous stitches are known in the art for creating a knitted article. Creating a knitted article using a knit stitch, or a garter stitch, requires performing a knitted row on a front side of the knitted article, turning the knitted article over to make the back side the front side, and completing the next knitted row across the front side of the knitted article. As such, when a knitted article is created using a garter stitch, the knitted rows alternate on opposite sides of the fabric. In a knitted article created using a garter stitch, the knitted article is said to include a knit side and a purl side. The purl side is referred to as the back of the knit side and when knitting the fabric using a garter stitch, alternating rows of knits and purls are created on each side of the knitted article. When viewing the knitted article from one side, the stitches that protrude from the knitted article are the purl stitches and the recessed stitches are the knit stitches. When it is necessary to repair or change the stitches in such a knitted article, the dropped knit stitches are pulled through from the front side of the knitted article and the dropped purl stitches are pulled through from the back side of the knitted article. Similarly, a knitted article created using a seed stitch has a knitting pattern that alternates between knit stitches and purl stitches. With a seed stitch, once the initial row of stitches is complete, on the next and subsequent rows, each of the knit stitches is purled and each of the purl stitches is knitted. As such, in repairing a dropped stitch in a seed stitch, the dropped knit stitches are pulled through from the back side of the knitted article and the dropped purl stitches are pulled through from the front side of the knitted article.

Figure 1B:
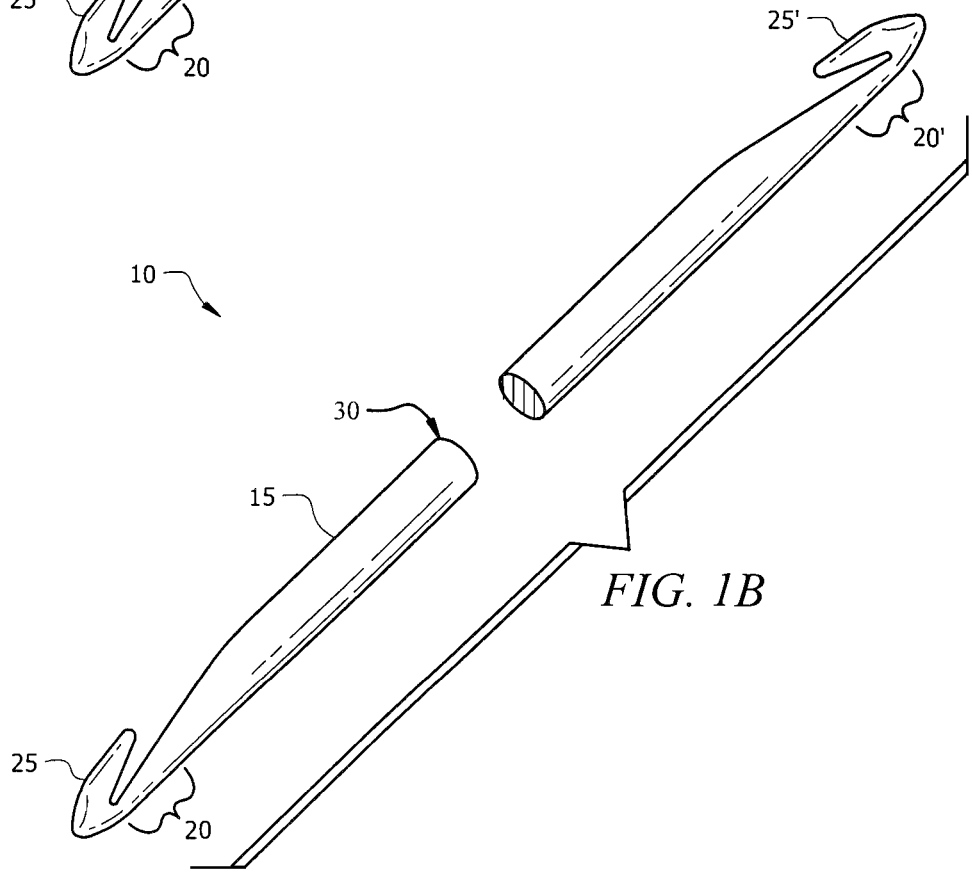

A device for repairing dropped stitches in a knitted article is illustrated with reference to FIG. 1. The knitting repair tool 10 of FIG. 1 includes a substantially rigid elongated shaft 15 of relatively short length having a substantially circular cross-section 30. The elongated shaft 15 has a first end and a second end, wherein the first end has a first throat 20 tapering to a first hook 25 and the second end has a second throat 20' tapering to a second hook 25'. The first hook 25 and the second hook 25' are of substantially the same dimension as the circular cross-section 30 of the elongated shaft 15 and the first hook 25 is substantially aligned with the second hook 25', with the hooks facing inwardly toward the shaft 15.

Having a first hook 25 and a second hook 25"positioned at opposite ends of the elongated shaft 15 allows a user to repair a first dropped stitch of a series of dropped stitches in a knitted article and to repair a second dropped stitch in the series of dropped stitches, without needing to remove the first repaired stitch from the knitting repair tool 10 in order to repair the second stitch. As such, the possibility of dropping a stitch when repairing a series of dropped stitches in the knitted article is greatly reduced.

In addition, having a first hook 25 and a second hook 25"positioned at opposite ends of the elongated shaft 15 allows a user to repair a first dropped stitch of a series of dropped stitches in a knitted article and to repair a second dropped stitch in the series of dropped stitches, without needing to rotate the knitted article 180° in order to repair the second stitch. As such, dropped stitches originating on both the front side and the back side of the knitted article can be efficiently repaired with the knitting repair tool without rotating the knitted article.

Additionally, having a first hook 25 and a second hook 25"positioned at opposite ends of the elongated shaft 15 and having the two hooks aligned with each other and facing inward toward the elongated shaft 15 allows a user to repair a first dropped stitch of a series of dropped stitches in a knitted article and to repair a second dropped stitch in the series of dropped stitches, without inadvertently twisting the first repaired stitch. If the hooks were not aligned, and as such were faced towards opposite sides of the elongated shaft 15, the first repaired stitch would need to be released from the elongated shaft 15 in order to avoid twisting the thread when repairing the second dropped stitch.

Having a first hook 25 and a second hook 25"positioned at opposite ends of the elongated shaft 15, wherein the two hooks are of substantially the same size allows a user to repair a first dropped stitch in a series of dropped stitches in a knitted article and to repair a second dropped stitch in the series of dropped stitches, wherein the stitches will be substantially the same size. Because the size of the hooks affects the size of the recovered stitches, if the hooks were not substantially the same size, the first recovered stitch and the second recovered stitch may not be similarly sized after the repair is made, which is an undesirable result in the knitted article.

To facilitate the repair of the dropped stitches in the knitted article, the knitting repair tool is designed to be relatively short in length. In a specific embodiment, the length of the elongated shaft 15 is approximately between four inches and five inches. The relatively short length of the elongated shaft 15 allows a user to quickly and efficiently repair dropped stitches in a knitted article. The relatively short length of the elongated shaft 15 allows a user to comfortably manipulate the dropped stitches originating from either a front side or a back side of the knitted article while working from the front side of the knitted article. In contrast, a tool having an elongated shaft of a relatively long length, such as ten inches or more, would be difficult to manage when repairing dropped stitches in a knitted article. The design of the elongated shaft 15 being relatively short in length in an advantage of the knitting repair tool of the present invention.

The elongated shaft 15 may be substantially evenly dimensioned and substantially smooth over its length, thereby allowing the elongated shaft 15 of the knitting repair tool 10 to slide easily through the yarn of the knitted fabric.

A first throat 20 and a second throat 20' of the elongated shaft 15 of the knitting repair tool 10 may have has a depth substantially greater than a yarn thickness of the knitted article that is being repaired. As such, the throats 20, 20' securely hold the yarn within the hooks 25, 25' as the repair is being performed. If the throats 20, 20' of the knitting repair tool were not substantially deeper than necessary to accommodate the yarn of the knitted article being repaired, the yarn would be easily released from the hooks 25, 25' during the repair and the effectiveness of the knitting repair tool 10 for its intended purpose would be reduced.

In accordance with the present invention, a method for repairing dropped stitches in a knitted article includes, recovering a first dropped stitch by hooking a bottommost horizontal bar of a first dropped stitch and pulling the bottommost horizontal bar through an intact loop of the knitted article and recovering a second dropped stitch by hooking a next bottommost horizontal bar of the second dropped stitch and pulling the next bottommost horizontal bar through the first recovered stitch, wherein recovering the second dropped stitch is performed without releasing the first dropped stitch. This method can be repeated until all of the dropped stitches in the knitted article have been repaired.

The knitted article may be rotated 180° after recovering the first dropped stitch and before recovering the second dropped stitch, however it is not necessary to rotate the knitted article to recover the second dropped stitch after the first dropped stitch has been recovered.

With reference to FIG. 2A-2D, a method for repairing dropped stitches in a garter stitch knitted article 50 is illustrated wherein the dropped stitches include at least one dropped knit stitch 60 and at least one dropped purl stitch 65. To establish a common orientation for the repair of the knitted article 50, if the bottommost horizontal bar in the knitted article 50 is a purl bar, the knitted article 50 is rotated 180° so that the bottommost horizontal bar in the knitted article is a knit bar and as such, the bottommost horizontal bar is on a back side of the knitted article being repaired 50.

Figure 2A:
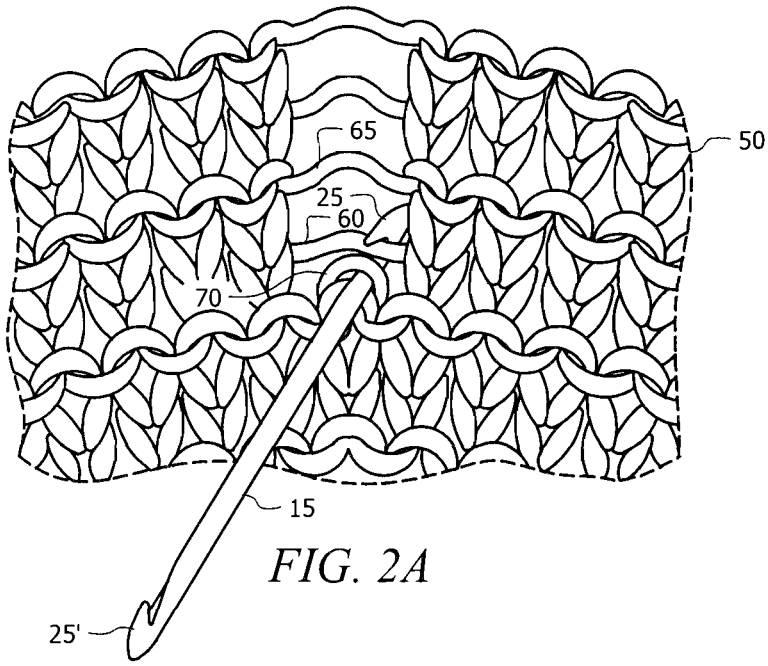
FIG. 2A-2D illustrates a method for repairing dropped stitches in a knitted article in accordance with the present invention.
Figure 2B:
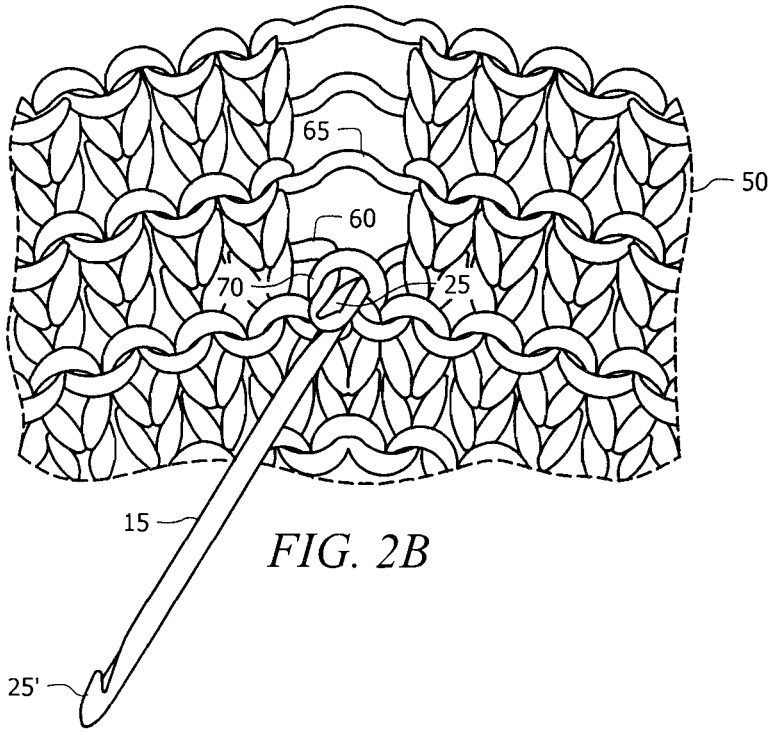
Figure 2C:
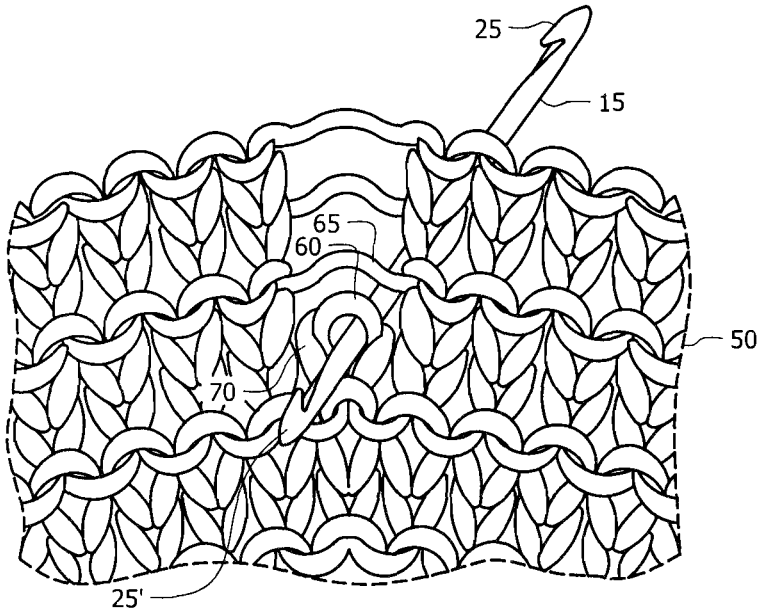
Figure 2D:
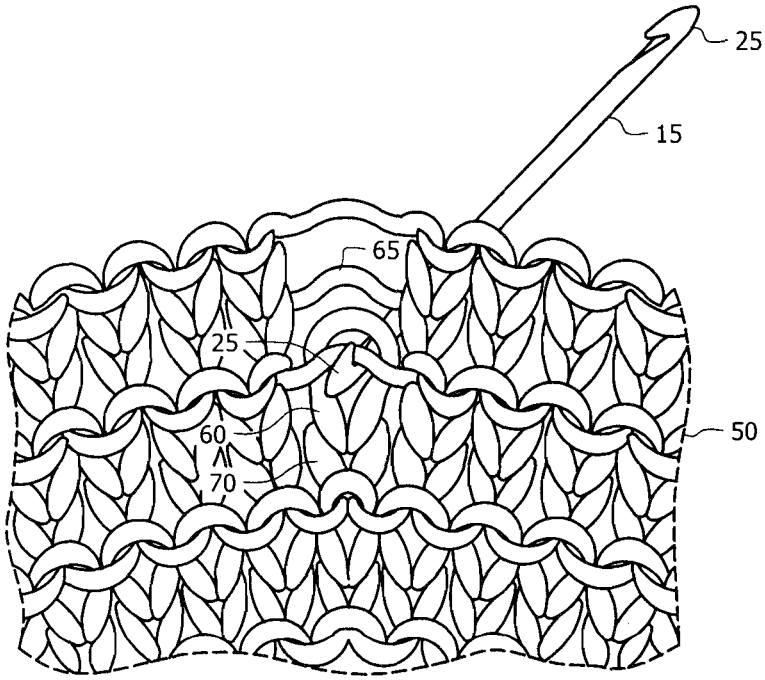

As shown in FIG. 2A, a first hook 25 of an elongated shaft 15 is inserted into an intact loop 70 from a front side of the knitted article 50. The intact loop 70 is the last complete loop in the column of dropped stitches. The first hook 25 is then positioned below the bottommost knit bar 60 and the first hook 25 is then used to hook the bottommost knit bar 60 from below. As shown in FIG. 2B, the bottommost knit bar 60 is then pulled through the intact loop 70 from the front side of the knitted article 70, thereby recovering the dropped knit stitch 60. As shown with reference to FIG. 2C, after the dropped knit stitch 60 has been recovered, the elongated shaft 15 is slid perpendicular to the knitted article 50 to position the recovered knit stitch 60 proximate to a second hook 25' of the elongated shaft 15. As shown in FIG. 2D, the second hook 25' is then positioned below the bottommost dropped purl bar 65 and the second hook 25' is then used to hook the bottommost purl bar 65 from below. The bottommost purl bar 65 is then pulled through the recovered knit stitch 60 from the back side of the knitted article 50, thereby recovering the dropped purl stitch 65. To repair additional stitches, the elongated shaft 15 may then be slid perpendicular to the knitted article 50 to position the recovered purl stitch 65 proximate to the first hook 25 and the method can be repeated by hooking the next dropped knit bar with the first hook 25.

The method illustrated in FIG. 2A-2D is referred to as a "below the bar" method for repairing a garter stitch because the hooks at each end of the elongated shaft are used to hook the knit bar and the purl bar from below.

An additional embodiment, illustrated in FIG. 3A-3F, is referred to as an "above the bar" method for repairing a garter stitch because the hooks at each end of the elongated shaft are used to hook the knit bar and the purl bar from above.

Figure 3A:
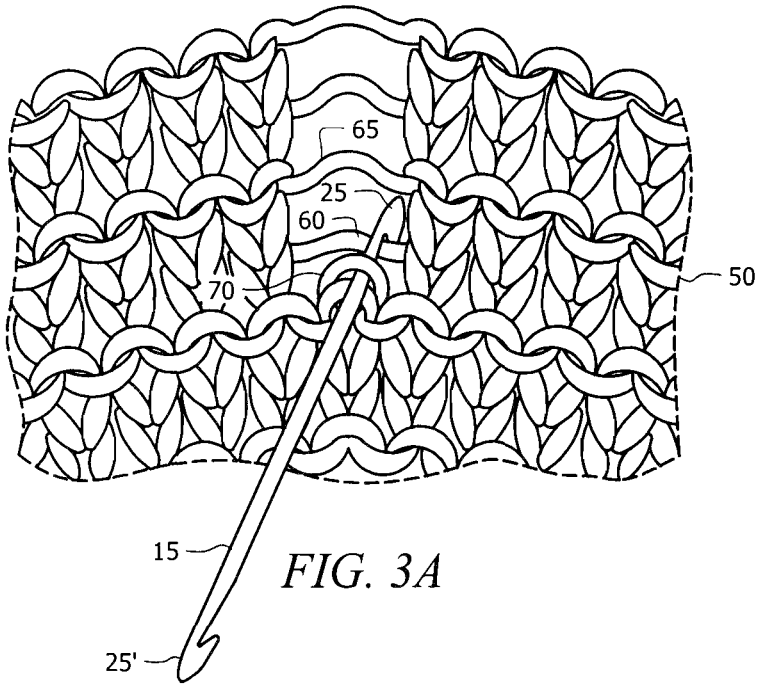
FIG. 3A-3F illustrates an additional method for repairing dropped stitches in a knitted article in accordance with the present invention.
Figure 3B:
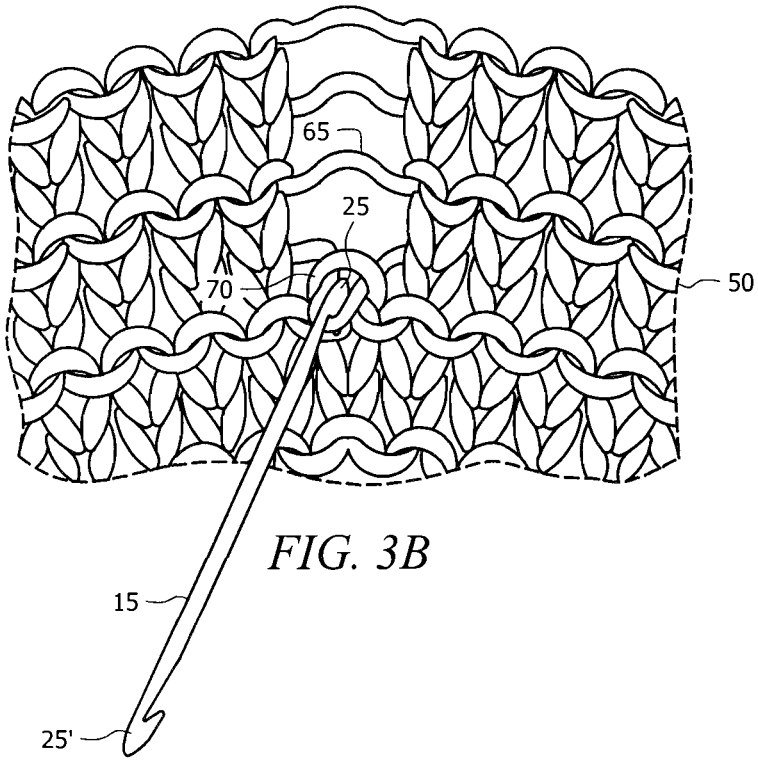
Figure 3C:
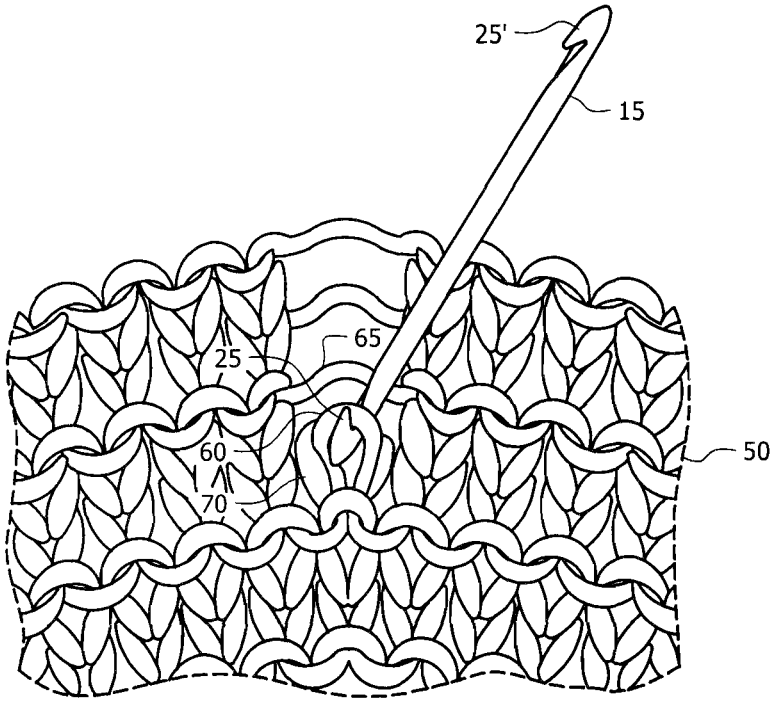
Figure 3D:
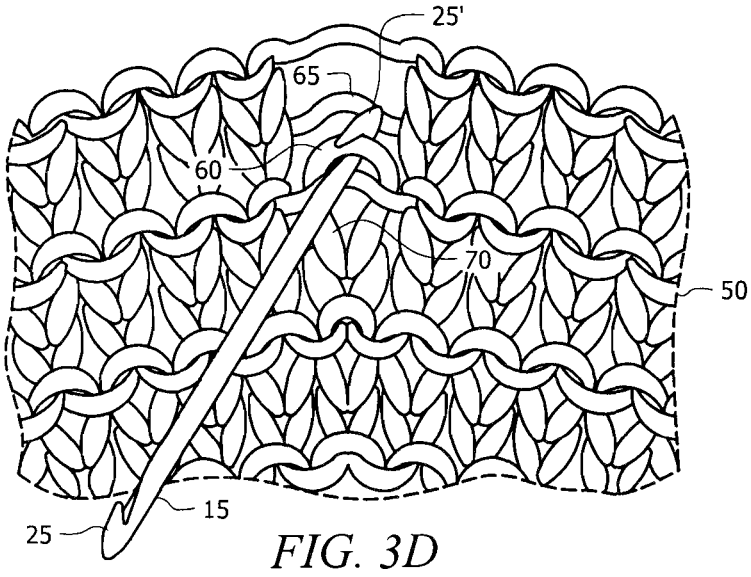
Figure 3E:
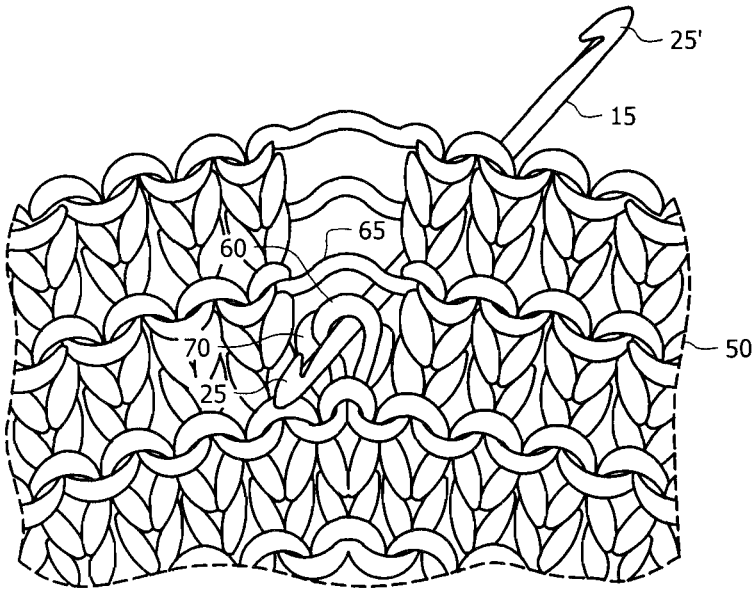
Figure 3F:
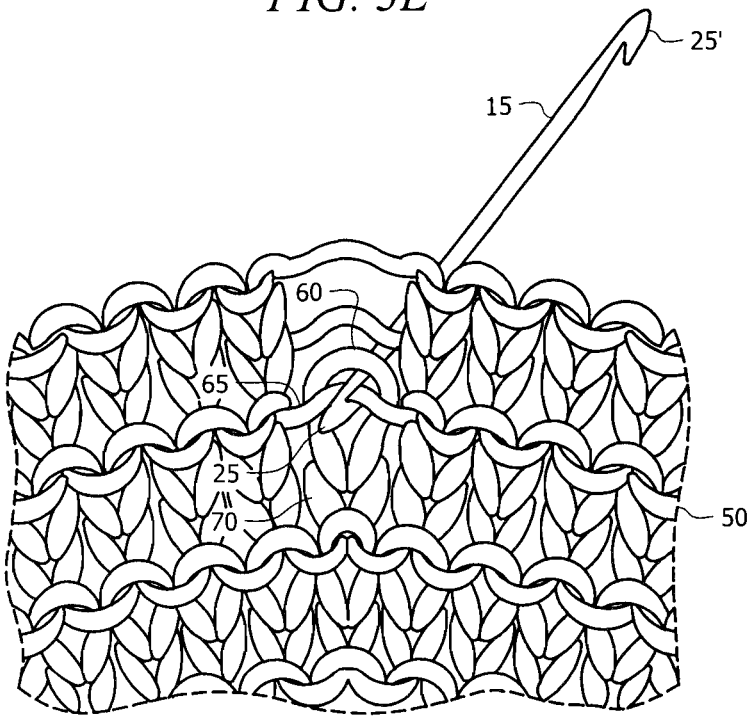

With reference to FIG. 3A, a first hook 25 of the elongated shaft 15 is inserted into the intact loop 70 from a front side of the knitted article. As shown in FIG. 3A, a first hook 25 of an elongated shaft 15 is inserted into an intact loop 70 from a front side of the knitted article 50. The intact loop 70 is the last complete loop in the column of dropped stitches. The first hook 25 is then positioned below the above most knit bar 60 and the first hook 25 is then used to hook the bottommost knit bar 60 from above. As shown in FIG. 3B, the bottommost knit bar 60 is then pulled through the intact loop 70 from the front side of the knitted article 50, thereby recovering the dropped knit stitch 60. As shown with reference to FIG. 3C, after the dropped knit stitch 60 has been recovered, to avoid twisting the recovered knit stitch 60, the elongated shaft is first pivoted 180° about the recovered knit stitch 60 to position the first hook 25 facing outwardly from the knitted fabric 50 and then the elongated shaft 15 is slid parallel to the knitted article 50, through the recovered knit stitch 60, to position the recovered knit stitch 60 proximate to a second hook 25' of the elongated shaft 15, as shown in FIG. 3D. As shown in FIG. 3E, the elongated shaft 15 is then slid perpendicular to the knitted article 50 to position the recovered knit stitch 60 proximate to the first hook 25 of the elongated shaft 15. The first hook 25 is then positioned above the bottommost dropped purl bar 65 and the first hook 25 is then used to hook the bottommost purl bar 65 from above, as shown in FIG. 3F. The bottommost purl bar 65 is then pulled through the recovered knit stitch 60 from the back side of the knitted article 50, thereby recovering the dropped purl stitch 65. In order to repair additional stitches after the dropped purl stitch 65 has been recovered and to avoid twisting the recovered purl stitch 65, the elongated shaft 15 is first pivoted 180° about the recovered purl stitch 65 to position the first hook facing outwardly from the knitted fabric 50 and then the elongated shaft 15 is slid parallel to the knitted article 50, through the recovered purl stitch 65 to position the recovered purl stitch 65 proximate to the second hook 25' of the elongated shaft 15. The elongated shaft may then be slid perpendicular to the knitted article 50 to position the recovered purl stitch 65 proximate to the first hook 25 and the method can be repeated by hooking the next dropped knit bar with the first hook 25.

In additional embodiments, the "under the bar" method illustrated in FIG. 2A-2D may be combined with the "over the bar" method illustrated in FIG. 3A-3F. In one embodiment, the "under the bar" method may be used to recover a dropped knit stitch and the "over the bar" method may then be used to recover a dropped purl stitch. In another embodiment, the "over the bar" method may be used to recover a dropped knit stitch and the "under the bar" method may then be used to recover a dropped purl stitch.

Figure 4A:
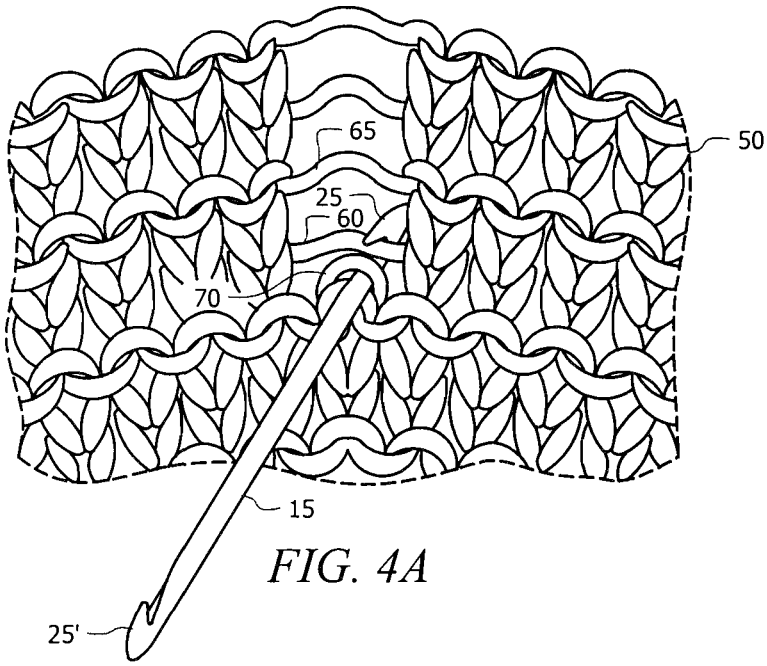
FIG. 4A-4E illustrates an additional method for repairing dropped stitches from the front side of a knitted article in accordance with the present invention.
Figure 4B:
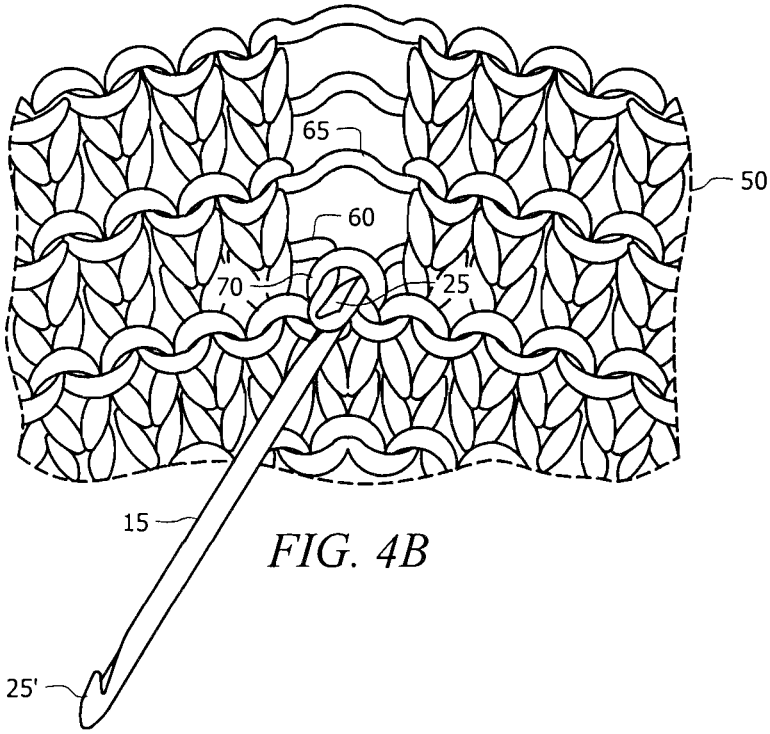
Figure 4C:
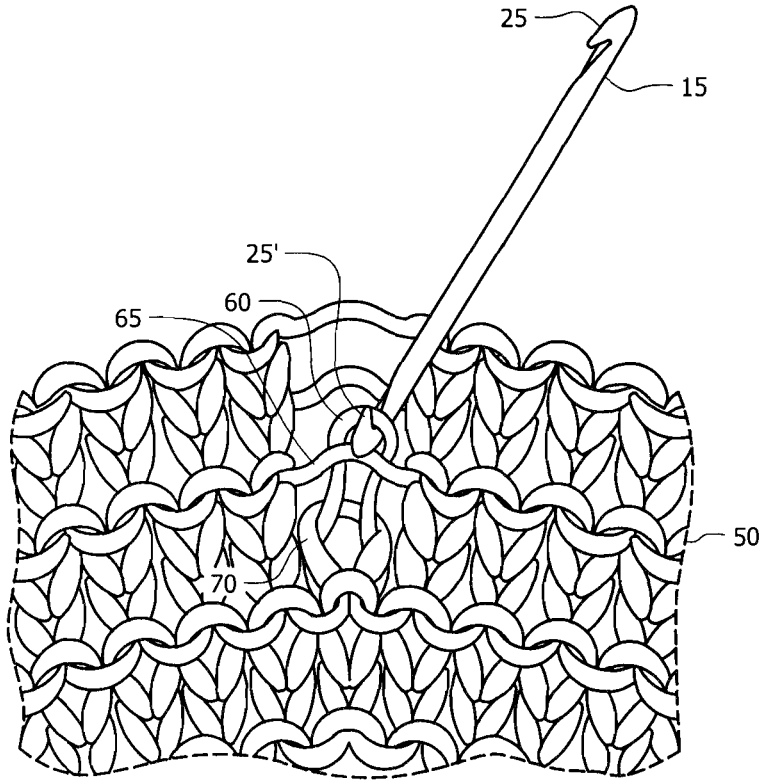
Figure 4D:
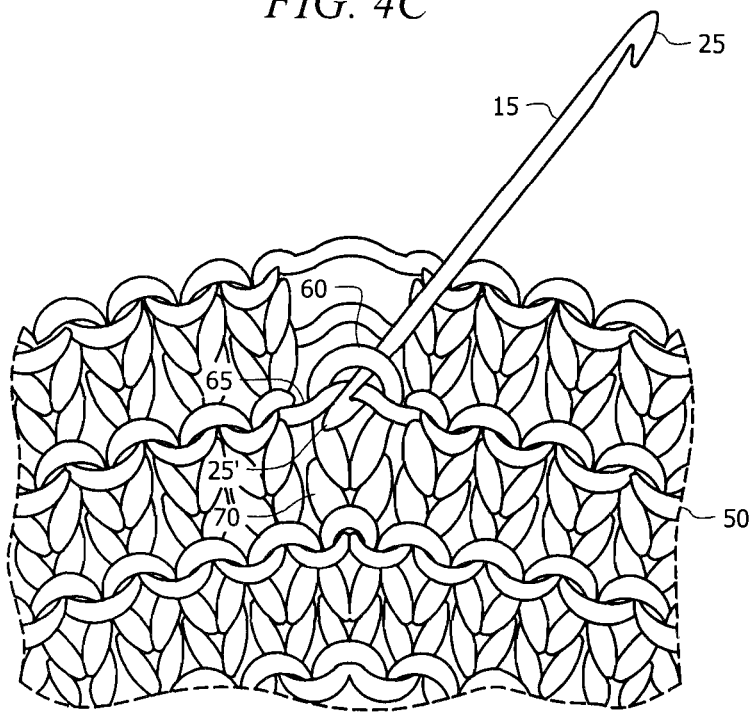
Figure 4E:
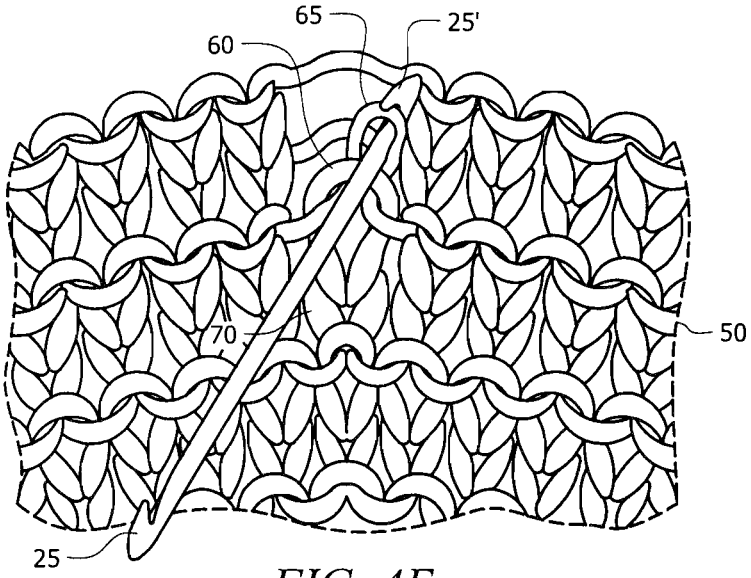

In an additional embodiment illustrated in FIG. 4A-4E, a garter stitch comprising knit bars and purl bars may be repaired entirely from the front side of the article. In this embodiment With reference to FIG. 4A, the knitted article 50 is rotated 180° such that the bottommost horizontal bar is a bottommost knit bar and the next bottommost horizontal bar is a bottommost purl bar if the bottommost horizontal bar is a bottommost purl bar and then a first hook 25 of an elongated shaft 15 is inserted into the intact loop 70 from a front side of the knitted article 50. The intact loop 70 is the last complete loop in the column of dropped stitches. The first hook 25 is then positioned below the bottommost knit bar 60 and the first hook 25 is then used to hook the bottommost knit bar 60 from below. As shown in FIG. 4B, the bottommost knit bar 60 is then pulled through the intact loop 70 from the front side of the knitted article 50, thereby recovering the dropped knit stitch 60. As shown with reference to FIG. 4C, after the dropped knit stitch 60 has been recovered, the elongated shaft 15 is slid parallel to the knitted article 50 and behind the bottommost purl bar 65 to position the recovered knit stitch 60 proximate to the second hook 25' of the elongated shaft 15. The second hook 25' is then used to hook the recovered knit stitch 60 and to pull the recovered knit stitch 60 behind the bottommost purl bar 65 to position the recovered knit stitch 60 and the second hook 25' above the bottommost purl bar 65. The elongated shaft 15 is then rotated to position the second hook 25' to face downward and then the second hook 25' is used to hook the bottommost purl bar 65 from above, as shown in FIG. 4D. The second hook 25' is then used to pull the bottommost purl bar 65 through the recovered knit stitch 60 from the front side of the knitted article 50, thereby recovering the dropped purl stitch 65, as shown in FIG. 4E. As such, in this embodiment, the knit stitch 60 and the purl stitch 65 are both recovered from the front side of the knitted article 50. The elongated shaft 15 may then be pivoted about the recovered purl stitch 65 to position the recovered purl stitch proximate to the second hook 25' of the elongated shaft and to position the second hook 25' to face upward and the method can be repeated by hooking the next dropped knit bar with the second hook 25' and repeating the method until each of the dropped stitches in the knitted article 50 are repaired.

In a seed stitched knitted article, dropped stitches are recovered by knitting the purl bars and purling the knit bars. As such, in a method to repair dropped stitches in a seed stitched knitted article 50, the knitted article 50 is positioned such that the bottommost horizontal bar is a knit bar. After the orientation of the knitted article 50 is established, a first hook 25 of the elongated shaft 15 is inserted into the intact loop 70 from a front side of the knitted article 50. In order to purl the bottommost dropped knit bar 60, the elongated shaft 15 is slid perpendicular to the knitted fabric, through the intact loop 70 to position a second hook 25' of the elongated shaft 15 proximate to the intact loop 70. The second hook 25' may then be positioned either above or below the bottommost dropped knit bar 60. With the second hook 25' positioned below the bottommost dropped knit bar 60, the second hook 25' is used to hook the bottommost knit bar 60 from below and to pull the bottommost knit bar 60 through the intact loop 70 from the back side of the knitted article 50. With the second hook 25' positioned above the bottom most dropped knit bar 60, the second hook 25' is used to hook the bottommost knit bar 60 from above and to pull the bottommost knit bar 60 through the intact loop 70 from the back side of the knitted article 50. If the bottommost knit bar 60 is hooked from above, in order to avoid twisting the recovered knit stitch 60 before recovering the next purl stitch, the elongated shaft 15 is pivoted about the recovered knit stitch 60 and the elongated shaft 15 is slid parallel to the knitted fabric 50 to position the recovered knit bar 60 proximate to the first hook 25 of the elongated shaft. After the knit stitch 60 of the seed stitch has been recovered, the elongated shaft 15 is slid perpendicular to the knitted article 50 to position the recovered knit bar 60 proximate the second hook 25' of the elongated shaft 15. The bottommost purl bar 65 may then be hooked from below with the second hook 25' and pulled through the recovered knit bar 60 from the front side of the knitted article 50, thereby recovering the dropped purl stitch 65. In an additional embodiment, the bottommost purl bar 65 may be hooked from above with the second hook 25' and pulled through the recovered knit bar 60 from the front side of the knitted article 50 to recover the dropped purl stitch 65. With this embodiment, to avoid twisting the recovered purl stitch 65, the elongated shaft 15 would need to be pivoted and slid parallel to the knitted fabric 50 prior to recovering the next knit stitch.

In addition to repairing dropped stitches in a knitted article, it is within the scope of the present invention to use the knitting repair tool to repair other knitting mistakes within a knitted fabric. In an exemplary embodiment, the knitting repair tool may be used to change a stitch to a knit stitch that was mistakenly knitted as a purl stitch. Additionally, methods similar to those disclosed may be used to repair various knitting mistakes within a knitted article in addition to repairing dropped stitches. The methods disclosed may be used to change a purl stitch to a knit stitch within the knitted article.

The foregoing descriptions of specific embodiments of have been presented for purposes of illustration and description. They are not intended to be exhaustive or to limit the invention to the precise forms disclosed, and obviously many modifications and variations are possible in light of the above teaching. The embodiments were chosen and described in order to best explain the principles and practical applications, to thereby enable others skilled in the art to best utilize the various embodiments with various modifications as are suited to the particular use contemplated. It is intended that the scope be defined by the claims appended hereto and their equivalents.

The invention claimed is:

1. A method for repairing dropped stitches in a knitted article, the method comprising:

recovering a first dropped stitch by hooking a bottommost horizontal bar of a first dropped stitch and pulling the bottommost horizontal bar through an intact loop of the knitted article; and recovering a second dropped stitch by hooking a next bottommost horizontal bar of the second dropped stitch and pulling the next bottommost horizontal bar through the first recovered stitch, wherein recovering the second dropped stitch is performed without releasing the first recovered stitch, wherein the knitted article is a garter stitch knitted article comprising at least one dropped knit stitch and at least one dropped purl stitch and wherein recovering the first dropped stitch and recovering the second dropped stitch further comprises:

rotating the knitted article 180° such that the bottommost horizontal bar is a bottommost knit bar and the next bottommost horizontal bar is a bottommost purl bar if the bottommost horizontal bar is a bottommost purl bar;

inserting a first hook of an elongated shaft into the intact loop from a front side of the knitted article;

positioning the first hook below the bottommost knit bar and hooking the bottommost knit bar with the first hook from below;

pulling the bottommost knit bar through the intact loop from a front side of the knitted article with the first hook, thereby recovering the dropped knit stitch;

sliding the elongated shaft parallel to the knitted article and behind the bottommost purl bar to position the recovered knit stitch proximate to a second hook of the elongated shaft;

hooking the recovered knit stitch with the second hook of the elongated shaft;

pulling the recovered knit stitch behind the bottommost purl bar to position the recovered knit stitch and the second hook of the elongated shaft above the bottommost purl bar;

rotating the elongated shaft to position the second hook to face downward and hooking the bottommost purl bar with the second hook from above; and pulling the bottommost purl bar through the recovered knit stitch from the front side of the knitted article with the second hook, thereby recovering the dropped purl stitch.

2. The method of claim 1 further comprising:

pivoting the elongated shaft about the recovered purl stitch to position the recovered purl stitch proximate to the second hook of the elongated shaft and to position the second hook to face upward; and repeating the method until each of the dropped stitches in the knitted article are repaired.

3. A method for repairing dropped stitches in a knitted article, the method comprising:

recovering a first dropped stitch by hooking a bottommost horizontal bar of a first dropped stitch and pulling the bottommost horizontal bar through an intact loop of the knitted article; and recovering a second dropped stitch by hooking a next bottommost horizontal bar of the second dropped stitch and pulling the next bottommost horizontal bar through the first recovered stitch, wherein recovering the second dropped stitch is performed without releasing the first recovered stitch, wherein the knitted article is a garter stitch knitted article comprising at least one dropped knit stitch and at least one dropped purl stitch and wherein recovering the first dropped stitch and recovering the second dropped stitch further comprises:

rotating the knitted article 180° such that the bottommost horizontal bar is a bottommost knit bar and the next bottommost horizontal bar is a bottommost purl bar if the bottommost horizontal bar is a bottommost purl bar;

inserting a first hook of an elongated shaft into the intact loop from a front side of the knitted article;

positioning the first hook below the bottommost knit bar and hooking the bottommost knit bar with the first hook from below;

pulling the bottommost knit bar through the intact loop from a front side of the knitted article with the first hook, thereby recovering the dropped knit stitch;

sliding the elongated shaft perpendicular to the knitted article to position the recovered knit stitch proximate to a second hook of the elongated shaft;

positioning the second hook of the elongated shaft below the bottommost purl bar and hooking the bottommost purl bar with the second hook from below; and pulling the bottommost purl bar through the recovered knit stitch from a back side of the knitted article with the second hook, thereby recovering the dropped purl stitch.

4. The method of claim 3 further comprising:

sliding the elongated shaft perpendicular to the knitted article, through the recovered purl stitch, to position the recovered purl stitch proximate to the first hook of the elongated shaft; and repeating the method until each of the dropped stitches in the knitted article are repaired.

5. A method for repairing dropped stitches in a knitted article, the method comprising:

recovering a first dropped stitch by hooking a bottommost horizontal bar of a first dropped stitch and pulling the bottommost horizontal bar through an intact loop of the knitted article; and recovering a second dropped stitch by hooking a next bottommost horizontal bar of the second dropped stitch and pulling the next bottommost horizontal bar through the first recovered stitch, wherein recovering the second dropped stitch is performed without releasing the first recovered stitch, wherein the knitted article is a garter stitch knitted article comprising at least one dropped knit stitch and at least one dropped purl stitch and wherein recovering the first dropped stitch and recovering the second dropped stitch further comprises:

rotating the knitted article 180° such that the bottommost horizontal bar is a bottommost knit bar and the next bottommost horizontal bar is a bottommost purl bar if the bottommost horizontal bar is a bottommost purl bar;

inserting a first hook of an elongated shaft into the intact loop from a front side of the knitted article;

positioning the first hook above the bottommost knit bar and hooking the bottommost knit bar with the first hook from above;

pulling the bottommost knit bar through the intact loop from a front side of the knitted article with the first hook, thereby recovering the dropped knit stitch;

pivoting the elongated shaft about the recovered knit stitch;

sliding the elongated shaft parallel to the knitted article, through the recovered knit stitch, to position the recovered knit stitch proximate to a second hook of the elongated shaft;

sliding the elongated shaft perpendicular to the knitted article, through the recovered knit stitch, to position the recovered knit stitch proximate to the first hook of the elongated shaft;

positioning the first hook of the elongated shaft above the bottommost purl bar and hooking the bottommost purl bar with the first hook from above;

pulling the bottommost purl bar through the recovered knit stitch from a back side of the knitted article with the first hook, thereby recovering the dropped purl stitch;

pivoting the elongated shaft about the recovered knit stitch; and sliding the elongated shaft parallel to the knitted article, through the recovered purl stitch, to position the recovered purl stitch proximate to the second hook of the elongated shaft.

6. The method of claim 5, further comprising:

sliding the elongated shaft perpendicular to the knitted article, through the recovered purl stitch, to position the recovered purl stitch proximate to the first hook of the elongated shaft; and repeating the method until each of the dropped stitches in the knitted article are repaired.

7. A method for repairing dropped stitches in a knitted article, the method comprising:

recovering a first dropped stitch by hooking a bottommost horizontal bar of a first dropped stitch and pulling the bottommost horizontal bar through an intact loop of the knitted article; and recovering a second dropped stitch by hooking a next bottommost horizontal bar of the second dropped stitch and pulling the next bottommost horizontal bar through the first recovered stitch, wherein recovering the second dropped stitch is performed without releasing the first recovered stitch, wherein the knitted article is a garter stitch knitted article comprising at least one dropped knit stitch and at least one dropped purl stitch and wherein recovering the first dropped stitch and recovering the second dropped stitch further comprises:

rotating the knitted article 180° such that the bottommost horizontal bar is a bottommost knit bar and the next bottommost horizontal bar is a bottommost purl bar if the bottommost horizontal bar is a bottommost purl bar;

inserting a first hook of an elongated shaft into the intact loop from a front side of the knitted article;

positioning the first hook of the elongated shaft below the bottommost knit bar and hooking the bottommost knit bar with the first hook from below;

pulling the bottommost knit bar through the intact loop from a front side of the knitted article with the first hook, thereby recovering the dropped knit stitch;

sliding the elongated shaft perpendicular to the knitted article, through the recovered knit stitch, to position the recovered knit stitch proximate to a second hook of the elongated shaft;

positioning the second hook of the elongated shaft above the bottommost purl bar and hooking the bottommost purl bar with the first hook from above;

pulling the bottommost purl bar through the recovered knit stitch from a back side of the knitted article with the first hook, thereby recovering the dropped purl stitch;

pivoting the elongated shaft about the recovered knit stitch; and sliding the elongated shaft parallel to the knitted article, through the recovered purl stitch, to position the recovered purl stitch proximate to the second hook of the elongated shaft.

8. The method of claim 7, further comprising:

sliding the elongated shaft perpendicular to the knitted article, through the recovered purl stitch, to position the recovered dropped purl stitch proximate to the first hook of the elongated shaft; and repeating the method until each of the dropped stitches in the knitted article are repaired.

9. A method for repairing dropped stitches in a knitted article, the method comprising:

recovering a first dropped stitch by hooking a bottommost horizontal bar of a first dropped stitch and pulling the bottommost horizontal bar through an intact loop of the knitted article; and recovering a second dropped stitch by hooking a next bottommost horizontal bar of the second dropped stitch and pulling the next bottommost horizontal bar through the first recovered stitch, wherein recovering the second dropped stitch is performed without releasing the first recovered stitch, wherein the knitted article is a garter stitch knitted article comprising at least one dropped knit stitch and at least one dropped purl stitch and wherein recovering the first dropped stitch and recovering the second dropped stitch further comprises:

rotating the knitted article 180° such that the bottommost horizontal bar is a bottommost knit bar and the next bottommost horizontal bar is a bottommost purl bar if the bottommost horizontal bar is a bottommost purl bar;

inserting a first hook of an elongated shaft into the intact loop from a front side of the knitted article;

positioning the first hook of the elongated shaft above the bottommost knit bar and hooking the bottommost knit bar with the first hook from above;

pulling the bottommost knit bar through the intact loop from a front side of the knitted article with the first hook, thereby recovering the dropped knit stitch;

pivoting the elongated shaft about the recovered knit stitch;

sliding the elongated shaft parallel to the knitted article, through the recovered knit stitch, to position the recovered knit stitch proximate to a second hook of the elongated shaft;

sliding the elongated shaft perpendicular to the knitted article, through the recovered knit stitch, to position the recovered knit stitch proximate to the first hook of the elongated shaft;

positioning the first hook of the elongated shaft below the bottommost purl bar and hooking the bottommost purl bar with the first hook from below; and pulling the bottommost purl bar through the recovered knit stitch from a back side of the knitted article with the first hook, thereby recovering the dropped purl stitch.

10. The method of claim 9, further comprising:

sliding the elongated shaft perpendicular to the knitted article, through the recovered purl stitch, to position the recovered purl stitch proximate to the second hook of the elongated shaft; and repeating the method until each of the dropped stitches in the knitted article are repaired.

11. A method for repairing dropped stitches in a knitted article, the method comprising:

recovering a first dropped stitch by hooking a bottommost horizontal bar of a first dropped stitch and pulling the bottommost horizontal bar through an intact loop of the knitted article; and recovering a second dropped stitch by hooking a next bottommost horizontal bar of the second dropped stitch and pulling the next bottommost horizontal bar through the first recovered stitch, wherein recovering the second dropped stitch is performed without releasing the first recovered stitch, wherein the knitted article is a seed stitch knitted article comprising at least one dropped knit stitch and at least one dropped purl stitch, wherein recovering the dropped knit stitch and recovering the dropped purl stitch further comprises:

rotating the knitted article 180° such that the bottommost horizontal bar is a bottommost knit bar and the next bottommost horizontal bar is a bottommost purl bar if the bottommost horizontal bar is a bottommost purl bar;

inserting a first hook of an elongated shaft into the intact loop from a front side of the knitted article;

sliding the elongated shaft perpendicular to the knitted fabric, through the intact loop, to position the intact loop proximate to a second hook of the elongated shaft;

positioning the second hook of the elongated shaft above the bottommost knit bar and hooking the bottommost knit bar with the second hook from above;

pulling the bottommost knit bar through the intact loop from a back side of the knitted article with the second hook, thereby recovering the dropped knit stitch;

sliding the elongated shaft parallel to the knitted article, through the recovered knit stitch, to position the recovered knit stitch proximate to the first hook of the elongated shaft;

sliding the elongated shaft perpendicular to the knitted article, through the recovered knit stitch, to position the recovered knit stitch proximate to the second hook of the elongated shaft;

positioning the second hook of the elongated shaft below the bottommost purl bar and hooking the bottommost purl bar with the second hook from below; and pulling the bottommost purl bar through the recovered knit stitch from a front side of the knitted article with the second hook, thereby recovering the dropped purl stitch.

12. The method of claim 11, further comprising:

sliding the elongated shaft perpendicular to the knitted article, through the recovered purl stitch, to position the recovered purl stitch proximate to the first hook of the elongated shaft; and repeating the method until each of the dropped stitches in the knitted article are repaired.

13. A method for repairing dropped stitches in a knitted article, the method comprising:

recovering a first dropped stitch by hooking a bottommost horizontal bar of a first dropped stitch and pulling the bottommost horizontal bar through an intact loop of the knitted article; and recovering a second dropped stitch by hooking a next bottommost horizontal bar of the second dropped stitch and pulling the next bottommost horizontal bar through the first recovered stitch, wherein recovering the second dropped stitch is performed without releasing the first recovered stitch, wherein the knitted article is a seed stitch knitted article comprising at least one dropped knit stitch and at least one dropped purl stitch, wherein recovering the dropped knit stitch and recovering the dropped purl stitch further comprises:

rotating the knitted article 180° such that the bottommost horizontal bar is a bottommost knit bar and the next bottommost horizontal bar is a bottommost purl bar if the bottommost horizontal bar is a bottommost purl bar;

inserting a first hook of an elongated shaft into the intact loop from a front side of the knitted article;

sliding the elongated shaft perpendicular to the knitted fabric, through the intact loop, to position the intact loop proximate to a second hook of the elongated shaft;

positioning the second hook of the elongated shaft below the above the bottommost knit bar and hooking the bottommost knit bar with the second hook from above;

pulling the bottommost knit bar through the intact loop from a back side of the knitted article with the second hook, thereby recovering the dropped knit stitch;

sliding the elongated shaft parallel to the knitted article, through the recovered knit stitch, to position the recovered knit stitch proximate to the first hook of the elongated shaft;

sliding the elongated shaft perpendicular to the knitted article, through the recovered knit stitch, to position the recovered knit stitch proximate to at the second hook of the elongated shaft;

positioning the second hook of the elongated shaft below the bottommost purl bar and hooking the bottommost purl bar with the first hook from below; and pulling the bottommost purl bar through the recovered knit stitch from a front side of the knitted article with the second hook, thereby recovering the dropped purl stitch.

14. The method of claim 13, further comprising:

sliding the elongated shaft perpendicular to the knitted article, through the recovered purl stitch, to position the recovered dropped purl stitch proximate to the first hook of the elongated shaft; and repeating the method until each of the dropped stitches in the knitted article are repaired.

* * * * *